FIP7912 XR 4,141,417

United States Patent [19]

Schora et al.

[11] 4,141,417

[45] Feb. 27, 1979

[54] ENHANCED OIL RECOVERY

[75] Inventors: Frank C. Schora, Palatine; John C. Janka, Chicago, both of Ill.

[73] Assignee: Institute of Gas Technology, Chicago, Ill.

[21] Appl. No.: 831,937

[22] Filed: Sep. 9, 1977

[51] Int. Cl.[2] ..... E21B 43/22; E21B 43/25

[52] U.S. Cl. ..... 166/305 R; 166/273

[58] Field of Search ..... 166/252, 266, 267, 273, 166/274, 305 R, 261

[56] References Cited

U.S. PATENT DOCUMENTS

| | | | |
|---|---|---|---|
| 2,595,979 | 5/1952 | Pevere et al. | 166/305 R X |
| 2,623,596 | 12/1952 | Whorton et al. | 166/274 |
| 3,084,919 | 4/1963 | Slater | 166/266 X |
| 3,193,006 | 7/1965 | Lewis | 166/266 |
| 3,208,514 | 9/1965 | Dew et al. | 166/261 |
| 3,327,782 | 6/1967 | Hutsak | 166/266 X |
| 3,598,182 | 8/1971 | Justheim | 166/267 |
| 3,766,982 | 10/1973 | Justheim | 166/261 |
| 3,811,502 | 5/1974 | Burnett | 166/252 |

*Primary Examiner*—Stephen J. Novosad
*Assistant Examiner*—George A. Suchfield
*Attorney, Agent, or Firm*—Thomas W. Speckman

[57] ABSTRACT

A process for petroleum recovery from an underground deposit by injecting hydrogen-rich gas in the absence of added hydrogenation catalysts into the underground deposit, the gas and deposit being at temperatures of less than 300° F., maintaining the hydrogen-rich gas in contact with the petroleum at temperatures of less than 300° F. for a time sufficient to reduce to desired levels viscosity and sulfur content of the petroleum by reaction with the hydrogen followed by recovery of the petroleum from the underground deposit. One embodiment is specifically set forth injecting carbon dioxide into the underground deposit after the reaction of the petroleum and hydrogen to increase the petroleum mobility ratio and to utilize both the hydrogen and carbon dioxide produced by partial oxidation of produced petroleum at the well site and resulting in as low as down to about 20 percent of the original oil in place remaining in the reservoir.

10 Claims, No Drawings

ENHANCED OIL RECOVERY

This invention relates to a method of recovering petroleum from underground deposits by hydrogenation of the crude oil in situ at reservoir conditions of under 300° F. Such in situ hydrogenation also results in reduction of atmospheric pollutants, especially sulfur compounds. The process of this invention involves the in situ non-catalytic hydrodesulfurization of the crude oil. The in situ hydrogenation at reservoir conditions reduces the oil viscosity and in combination with carbon dioxide miscible slug flooding recovery efficiencies in the order of 80 percent of the original oil in place are attainable.

The prior art has recognized the benefits of in situ hydrogenation of oil reservoirs. However, the prior art teachings are that the in situ hydrogenation must take place at temperatures above those normally found in an underground oil reservoir and that various catalysts be used. For example, U.S. Pat. No. 3,051,235 teaches that the formation must be heated before hydrogenating with hydrogen and a gaseous catalyst; U.S. Pat. No. 3,102,588 similarly teaches the underground formation must be heated prior to and during hydrogenation; U.S. Pat. No. 3,208,514 teaches that in situ hydrogenation requires temperatures above 400° F.; and U.S. Pat. No. 3,327,782 teaches in situ hydrogenation of underground oil at elevated temperatures of 350° to 900° F. without a hydrogenation catalyst. There are less relevant teachings in the prior art relating to even more drastic conditions of hydrogenation, primarily to change the chemical nature of the petroleum such as by retorting or gasification. Other in situ methods for reducing the petroleum viscosity to enhance recovery involve greater heating by processes of in situ combustion, steam soaking and steam drive. Heat loss from the petroleum in the underground formation is large making fuel requirements very high. Also, the in situ combustion quite often burns much of the oil slated for recovery. In situ hyrogenation of oil shale using "hot hydrogen" is known as exemplified by U.S. Pat. Nos. 3,598,182, 3,766,982 and 3,084,919.

The use of carbon dioxide in petroleum recovery is known, for example, U.S. Pat. No. 3,841,406 teaches first treating the deposit with a gas having limited solubility in oil to increase the formation pressure and thereafter injecting a slug of carbon dioxide which reduces the viscosity and increases the volume of the oil due to solubility of the carbon dioxide in the oil. Use of carbon dioxide as a chasing gas following steam drive is taught by U.S. Pat. No. 3,425,492. Carbon dioxide flooding techniques require substantial amounts of carbon dioxide and are usually dependent on a significant source near the site.

The present invention involves the hydrogenation of in situ petroleum at ambient deposit temperatures of less than 300° F. and without an added hydrogenation catalyst. This is contrary to the teachings of the prior art known to the inventors as exemplified above. The in situ hydrogenation according to the process of the present invention reduces the viscosity and sulfur content of the petroleum in the formation to desired levels for enhanced production and satisfactory pollution standards. In a preferred embodiment, this invention utilizes in situ hydrogenation under ambient deposit temperatures of less than 300° F. in the absence of added hydrogenation catalyst in combination with injection of carbon dioxide after reaction of the petroleum with the hydrogen. The underground deposit treatment with hydrogen in the absence of a hydrogenation catalyst and at ambient deposit temperatures of less than 300° F. and the combination of carbon dioxide treatment subsequent to hydrogenation is, to the inventors' knowledge, new to the art. The combination of in situ hydrogenation followed by carbon dioxide flooding is advantageous also from the carbon dioxide supply standpoint since the carbon dioxide can be easily and economically produced as a by-product of hydrogen production at the site.

The process of this invention is directed to both enhanced recovery from wells which have been abandoned after utilizing conventional primary and secondary recovery techniques and to sources of petroleum deposits from which production has not been feasible by prior methods. Overall petroleum recovery efficiency of U.S. crude oil reserves has remained virtually constant at about 30% of the original oil in place, since 1930. Therefore, there is a vast quantity of crude oil still in place in U.S. reservoirs which is not accessible to conventional primary and secondary recovery techniques. Further, extensive petroleum deposits are located in tar sands which, owing to the highly viscous nature of the deposits, have not been effectively produced. Recent concern with reducing the level of atmospheric pollutants, especially sulfur compounds, has restricted the use to which high sulfur containing petroleum products can be put. The operation of suitable hydrodesulfurization in the refining process adds considerable to the cost of oil production. The process of this invention provides enhanced oil recovery and sulfur removal in one operation by in situ hydrogenation of crude oil in reservoirs and at reservoir conditions without the necessity for hydrogenation catalysts and heat input. Recovery efficiencies of up to about 80% of the original oil in place is attainable.

The process of this invention is carried out by injecting hydrogen-rich gas, in the absence of added hydrogenation catalysts, into an underground petroleum deposit and maintaining the hydrogen-rich gas in contact with the petroleum in situ in the deposit at temperatures of less than 300° F. for a time sufficient to reduce to desired levels, viscosity and sulfur content of the petroleum. Contrary to the teachings of U.S. Pat. No. 3,327,782, reverse combustion or otherwise heating of the reservoir, is not necessary to obtain sufficient reaction of the petroleum with hydrogen in situ. The hydrogen-rich gas can be introduced to the underground deposit at ambient temperatures and without a hydrogenation catalyst. The ambient temperatures of such deposits are normally less than 300° F. The hydrogenation rates comtemplated by the process of this invention, are low, but this is not of importance because of the long residence times available, assuring sufficient hydrogenolysis for reduction of petroleum viscosity and reduction of petroleum sulfur content. Hydrogen consumption of about 400 to 1200 standard cubic feet per barrel is contemplated according to the process of this invention. Dependent upon the type of petroleum, viscosity reductions as a result of in situ hydrogenation may be expected to range from about 3 times to about 15 times and hydrodesulfurization may be expected to be from about 40 to 85 percent. A preferred range of hydrogen consumption is about 600 to about 1000 standard cubic feet per barrel which can be expected to result in viscosity reduction of about 6 to 10 times and hydrodesulfurization of about 55 to 80 percent. The time of treatment of the in situ petroleum deposit varies greatly depending upon the conditions of the reservoir and the type of petroleum. Generally, times in the order of 1 to 18 months, or even longer, are suitable. The rate of injection of hydrogen into the underground reservoir is determined by the porosity of the reservoir, the pore volume of the reservoir and the available hydrogen at the reservoir site.

The injections of hydrogen into the petroleum reservoir may be on a continuous or intermittent basis and the pressure achieved in the reservoir may vary considerably depending upon the permeability of the reservoir and the injection rates, but are generally from about 500 to 3500 psig. The hydrogen contact with the petroleum in situ results in viscosity reduction, desulfurization and a decrease in the C/H ratio. The hydrogen for use in the process of this invention may be obtained from any suitable source. A preferred source is the manufacture of hydrogen by partial oxidation of petroleum produced at the site. There are a number recognized methods for carrying out such partial oxidation. The partial oxidation process also produces carbon dioxide. It is preferred to remove the major portion of carbon dioxide from the hydrogen produced to provide higher concentrations of hydrogen-containing gas for injection into the underground reservoir. It is preferred that the hydrogen-containing gas contain more than about 70 percent hydrogen.

In a preferred embodiment of the process of this invention, carbon dioxide is injected into the underground deposit after the reaction of the petroleum with hydrogen in situ. The carbon dioxide injected into the underground deposit improves the petroleum mobility ratio by reduction of oil-water interfacial tension. Carbon dioxide is not actually miscible with the reservoir oils, but generates a miscible solvent in situ concentrating the miscible solvent hydrocarbons at the carbon dioxide-oil interface. The carbon dioxide may be used as a displacing fluid itself, or it may be injected as a slug in front of a waterflood recovery process. When injected as a slug, the slug size should be in the order of about 15 to 25 percent of the pore volume of the reservoir. When used in this fashion, the balance between hydrogen and carbon dioxide produced by partial oxidation of petroleum, provides hydrogen and carbon dioxide in the proportions required for the process of this invention. Previously, carbon dioxide well treatments have been restricted to use where subsurface carbon dioxide reservoirs are nearby or SNG plants producing by-product carbon dioxide were readily available to the well site. The process of this invention provides efficient utilization of both the hydrogen and carbon dioxide produced by partial oxidation of about 3 to 7 percent of the petroleum produced. However, even with use of this amount of petroleum for manufacture of hydrogen and carbon dioxide at the well site, net recovery of oil up to about 75 percent of the original oil in place can be achieved. As low as about 20 percent of the original oil in place remaining in the reservoir can be achieved according to this invention involving in situ hydrogenation followed by carbon dioxide injection. A carbon dioxide slug injection according to this invention, may be followed by any conventional recovery technique such as waterflooding. A portion of a petroleum reservoir may be isolated for hydrogen treatment while a different isolated portion of the petroleum reservoir may be subjected to carbon dioxide injection and petroleum production, thus, obviating the necessity for extensive storage facilities at the site for either hydrogen or carbon dioxide.

The process of this invention is applicable to a wide variety of reservoir types including, sand, gravel, limestone and sandstone.

The following Example is set forth as exemplary of one embodiment of this invention and the use of specific mateerials or conditions is not meant to limit the invention.

EXAMPLE

The process of this invention is applied to a typical solution gas drive reservoir containing 43.5 million reservoir barrels of original oil in place. The reservoir characteristics are as follows:

| | |
|---|---|
| Rock Type | Sandstone |
| Depth | 6000 ft. |
| Original Pressure | 2500 psig |
| Original Temperature | 210° F. |
| Thickness of Pay Zone | 20 ft. |
| Area | 2000 acres |
| Porosity | 20% |
| Permeability | 400 md |

The oil properties in the reservoir are as follows:

| | |
|---|---|
| Oil Gravity | 20° API |
| Initial Water Saturation | 30% |
| Dissolved Gas | 300 SCF/STB |
| Viscosity at Reservoir Conditions | 2.0 cp |
| Formation Volume Factor | $\beta = 1.22$ |

The reservoir described above is a fairly permeable one, so that theoretical initial productivity indices of the order of 1.5 barrel/day/psi should be attainable with wells on a 50 acre spacing, 500 psig bottomhole pressure and 8 inch completion. A 5-spot pattern is established when initial wells are drilled.

Primary solution gas drive recovery by solution gas drive without pressure maintenance results in 21% recovery of the original oil in place. Secondary oil recovery attainable by conventional waterflooding can be estimated showing after waterflooding an additional 16% recovery of original oil in place. Thus, the total recovery by primary solution gas and secondary waterflooding is 37% of the original oil in place.

Hydrogen is injected into the formation at a hydrogen consumption amount of 800 SCF/barrel and remains in contact with the oil in formation until the viscosity is reduced by a factor of ten, to about 0.2 cp. At this hydrogenation level, about 70% of the original sulfur in the oil would be removed. The reduction in oil viscosity to 0.2 cp following conventional waterflooding result in recovery of 27% of the original oil in place, or a total of 64% of the original oil in place recovered by primary recovery, hydrogenation and water-flooding.

After hydrogenation, a carbon dioxide slug amounting to 15–25% of the pore volume at reservoir conditions, is injected resulting in recovery of 61% of the original oil in place as a result of the hydrogenation plus carbon dioxide injection plus waterflooding, giving an ultimate recovery of about 82% of the original oil in place.

The hydrogen and carbon dioxide can be produced at the well site by partial oxidation of heavy oil at a fuel efficiency of about 65%, or an oil consumption of 1,830,000 barrels. When injection is carried out over a one-year period, a hydrogen plant capacity of about 70 million SCF/day would be required. Such a plant can produce about $1.56 \times 10^{10}$ SCF of carbon dioxide during this time. The carbon dioxide requirement for miscible slug flooding is about $1.27 \times 10^{10}$ SCF. Therefore, there is a general balance between the hydrogen and carbon dioxide requirements. Further, some of the hydrogen sulfide produced can be re-injected along with the carbon dioxide to aid in reduction of the miscibility pressure. With the above oil requirements for hydrogen and carbon dioxide manufacture, the net recovery of oil totals 77% of the original oil in place.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. A process for enhanced oil recovery by wells from an underground deposit comprising:

injecting hydrogen-rich gas in the absence of added hydrogenation catalyst into said deposit, the gas and deposit being at ambient deposit temperatures of less than 300° F.;

maintaining the hydrogen-rich gas in contact with crude oil in reservoirs at ambient reservoir temperatures of less than 300° F. for a time sufficient to reduce to desired levels viscosity and sulfur content of said petroleum by reaction with said hydrogen; and recovering the liquid petroleum from said underground deposit.

2. The process of claim 1 wherein said hydrogen and petroleum reaction consumes about 400 to 1200 standard cubic feet of hydrogen per barrel of petroleum.

3. The process of claim 2 wherein said hydrogen consumption is about 600 to 1000 standard cubic feet of hydrogen per barrel of petroleum.

4. The process of claim 1 wherein said hydrogen and petroleum reaction reduces viscosity of the petroleum to about one-third to one-fifteenth its natural viscosity.

5. The process of claim 4 wherein the sulfur content of the petroleum is reduced to about 15 to 60 percent of its natural amount.

6. The process of claim 1 wherein carbon dioxide is injected into the underground deposit after the reaction of said petroleum with said hydrogen, in an amount sufficient to increase the petroleum mobility ratio.

7. The process of claim 6 wherein carbon dioxide is injected in an amount sufficient to saturate a zone of petroleum with carbon dioxide.

8. The process of claim 6 wherein carbon dioxide is injected as a slug of about 15 to 25 percent of the pore volume of the reservoir.

9. The process of claim 6 wherein the recovery of the petroleum from the underground deposit is by waterflooding.

10. The process of claim 6 wherein hydrogen and carbon dioxide is produced at the well site by partial oxidation of produced petroleum.

* * * * *